United States Patent [19]

Wells

[11] 4,223,999

[45] Sep. 23, 1980

[54] APPLICATOR FOR APPLYING A COATING OF STIPPLED PLASTER

[76] Inventor: Ralph W. Wells, 610 S. Beckey Station Rd., Louisville, Ky. 40223

[21] Appl. No.: 970,657

[22] Filed: Dec. 18, 1978

[51] Int. Cl.[3] ..... B05C 17/10

[52] U.S. Cl. ..... 401/176; 401/261; 401/266; 401/200; 222/386

[58] Field of Search ..... 401/261, 266, 267, 170, 401/171, 150, 176, 200; 222/386

[56] References Cited

U.S. PATENT DOCUMENTS

| | | | |
|---|---|---|---|
| 600,953 | 3/1898 | Rabbi et al. | 222/386 |
| 943,892 | 12/1909 | Reed | 222/386 |
| 1,641,765 | 9/1927 | Krank | 401/170 |
| 2,085,446 | 6/1937 | Philippe | 222/386 |
| 2,176,795 | 10/1939 | Hartley | 401/264 |
| 2,249,401 | 7/1941 | Sieg | 401/266 |
| 2,636,214 | 4/1953 | Slusher | 401/176 |
| 3,162,884 | 12/1964 | Bordwine et al. | 401/170 |
| 3,203,024 | 8/1965 | Hawkins | 401/266 |
| 3,237,237 | 3/1966 | Hager et al. | 401/28 |
| 3,276,067 | 10/1966 | Boyle et al. | 401/205 |
| 3,337,900 | 8/1967 | Schwartzman | 401/206 |
| 3,570,396 | 3/1971 | Schwartzman | 401/206 |
| 3,742,949 | 7/1973 | Hill | 222/386 |
| 3,744,922 | 7/1937 | Fears | 401/206 |

*Primary Examiner*—William Pieprz
*Attorney, Agent, or Firm*—Vincent L. Ramik

[57] ABSTRACT

An applicator is shown for applying a thin coating of stippled plaster or stucco to a ceiling or wall structure. The applicator includes an elongated tubular member that has an open top and is fitted with a piston having an elongated handle that is attached to its underside. The plaster compound is loaded into the tubular member on top of the piston. A porous cover in the form of a net material of fine mesh is fastened over the top end of the tubular member. The plaster compound may be extruded through the porous cover by moving the handle towards the surface to be stippled so as to bring the cover and the top edge of the tubular member into engagement with the said surface.

18 Claims, 3 Drawing Figures

APPLICATOR FOR APPLYING A COATING OF STIPPLED PLASTER

BACKGROUND OF THE INVENTION

1. Field of the Invention

This invention relates to a tool or an applicator for applying a thin coating of stippled plaster or stucco to a ceiling or wall structure. The applicator is not a roller, a brush, a trowel or a spray gun.

2. Description of the Prior Art

Probably the most common method of applying a thin coating of stippled plaster to a ceiling of a room is by mixing the plaster compound with water to make it of liquid paint rather than of mud consistency. Then by dipping a roller on a long handle into the liquid plaster and rolling the compound onto the ceiling. The nap of a stipple roller is longer than the nap of a paint roller so as to deposit more points or gradations into the plaster compound. Before the stippled coating dries and hardens, a brush is daubed into the plaster compound, again to create more points or gradations and establish a generally uniform overall pattern.

One serious disadvantage in using a roller and brush method of applying a stippled plaster coating is the amount of water that must be added to the plaster compound, as received from the manufacturer. The presence of the water with the plaster compound makes the material susceptible to ambient temperature and humidity. Moreover, if the liquid plaster compound is applied onto dry wall, the water in the compound is liable to be absorbed by the dry wall, causing the dry wall to expand, sag and distort. A skilled operator can control the water-plaster compound mixture and the quantity of the mixture which is applied per square foot of dry wall. But, inexperienced operators frequently run into difficulty and spoil the end product, requiring the wall board to be renailed and the joints resealed.

Another common method of applying a stippled plaster coating to a ceiling or wall structure is to use expensive spraying equipment, which again must use a water-plaster compound mixture. Hence, skilled operators are needed to use spray equipment so as not to spoil the job with excessive water absorption into the dry wall material.

Another common method of applying a stippled plaster coating is by using a trowel and a mortar board. This method requires the operator to erect a scaffolding so he can reach the ceiling with ease, or the operator uses special stilts which are strapped to his legs.

The Jacoby U.S. Pat. No. 2,708,763 shows an early form of fountain type or paint roller having a hollow roller which serves as a reservoir and is pivoted from a handle at its opposite ends. The roller has a porous cover and a plurality of adjustable perforations for varying the flow rate of the paint. This applicator is not for use in applying stippled plaster as is the present invention.

The Rosenthal U.S. Pat. No. 2,873,464 describes a stenciling nib having a stenciling marking surface which is fed by either a felt pad or a reservoir of ink formed by a hollow handle. This design is also not suitable as an applicator of a coating of stippled plaster.

The Hoveland U.S. Pat. No. 3,186,056 shows a roller-mounted tool for applying plaster to wall surfaces of wallboard with a rectangular plaster chamber having a narrow elongated opening along one bottom wall edge and mounting means for a troweling blade to control the flow of plaster through the opening. A lever-operated slidably mounted pressure plate is used in conjunction with the plaster holding chamber to apply pressure to the plaster mass and eject it from the elongated opening in the chamber. This tool would not be useful in applying a thin stippled plaster coating as is envisioned by the use of the present invention.

The Truhan U.S. Pat. No. 3,519,364 describes a single use applicator swab used in the medical profession as a testing device for facilitating the culture and subsequent analysis of different types of microorganisms obtained in situ from a living organism such as the human body. There is an elongated tube that is partially filled with a solution. An absorbent wadding is placed around the lower end of the tube, and a plunger is fitted within the bore to cause exit of the solution to pass from the bore through the wadding. The wadding is then ready for use as an applicator or swab.

OBJECTS OF THE PRESENT INVENTION

The principal object of the present invention is to provide an applicator for applying a thin coating of stippled plaster to a ceiling or wall structure using the plaster compound in an "as received" condition from the manufacturer, and applying it in a one-step position.

A further object of the present invention is to provide a stippler applicator of the class described with a tubular member having a porous cover means of fine mesh net material and a piston member with a long handle working in the tubular member so as to extrude the plaster compound through the net when the applicator is raised and bumped against the ceiling.

A further object of the present invention is to provide a stippler applicator of the class described where the porous cover means is easily removable for loading the plaster compound into the tubular member.

A further object of the present invention is to provide a stippler applicator of the class described which has an elongated handle and piston that is tiltable with respect to a tubular member that holds the plaster compound so that the top edge of the tubular member will seat flush against the ceiling when the handle is raised to daub the ceiling with plaster compound.

Still another object of the present invention is to provide a stippled plaster applicator of the class described with means for preventing the plaster compound from spilling down over the top edge of the tubular member.

SUMMARY OF THE INVENTION

The present invention provides a tool or an applicator for applying a thin coating of stippled plaster or stucco to a drywall or plaster ceiling or a wall structure. The applicator includes an elongated tubular member having a lower piston that is furnished with an elongated handle. The plaster compound is loaded into the tubular member by lifting or removing a porous cover member that is fitted on the top end of the tubular member. The operator will raise the handle until the tubular member bumps against the ceiling which extrudes a thin coating of plaster compound through the porous cover. The top edge of the tubular member also strikes the ceiling to form a dam or trap around the stippled plaster coating on the top of the applicator to prevent spill-overs that would otherwise run down the outside.

BRIEF DESCRIPTION OF THE DRAWINGS

This invention will be better understood from the following description taken in conjunction with the accompanying drawings and its scope will be pointed out in the appended claims.

DESCRIPTION OF THE PREFERRED EMBODIMENTS

Figure 1:
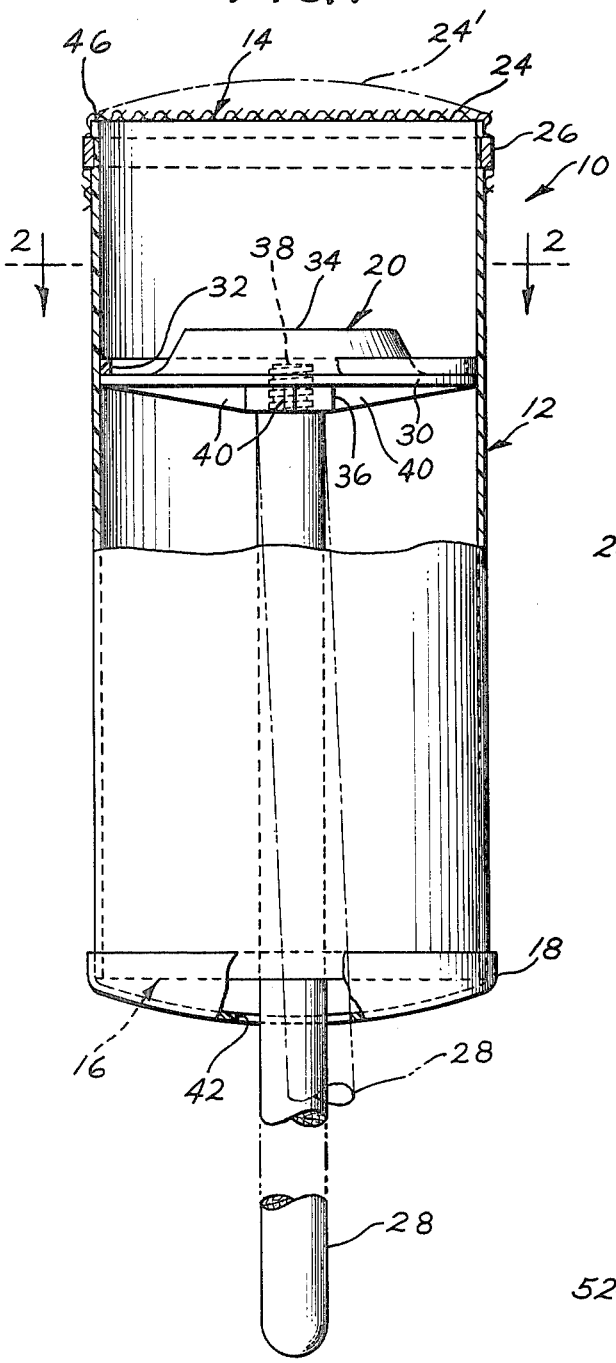
FIG. 1 is a fragmentary cross-sectional elevational view of an applicator or tool for applying a thin coating of stippled plaster as is embodied in the present invention, where only a portion of the elongated handle is shown. Notice that the open top of the applicator is covered by a porous net material of fine mesh through which the plaster compound is extruded.

Turning now to a consideration of the drawings and, in particular, to the vertical, cross-sectional view of FIG. 1, there is shown a stipple applicator 10 in its vertical use position for applying a stippled plaster, stucco, cement or a thick paint substance to a ceiling or other wall structure. The applicator 10 comprises an elongated tubular member 12 having an open top end 14 and a bottom end 16 that is closed by an end cap 18.

The tubular member 12 is fitted with a piston 20 that is adapted to travel longitudinally within the tubular member. The plaster compound is adapted to be loaded into the tubular member 12 through the open top end 14 and onto the piston 20.

A porous cover means or extrusion head 24 is placed over the open top end 14 and folded down over the edges and then fastened in place by a clamping strap 26. The porous cover means or extrusion head 24 may be a nylon net material of fine mesh of a single or multiple layers. Other similar materials may be substituted for the nylon net material. A thin molded plastic or metal screen of fine mesh could also be adopted. The extrusion head 24 is best if it is not absolutely stiff and rigid. It is best if it has a little flexibility.

The piston 20 is provided with an elongated handle 28 such as a regular four foot long paint roller handle that screws into the underside of the piston. The piston 20 is generally a flat plate 30 with a narrow peripheral rim 32 and a central raised top surface 34. The underside of the piston has a central hub 36 with an internally threaded bore 38 and a series of tapered, radial reinforcing ribs 40 for strengthening the piston. The end of the handle 28 has a threaded ferrule which screws into the piston hub 36. The bottom end cap 18 has an oversized central hole 42 for receiving the handle therethrough. The purpose of the bottom end cap is to stabilize and guide the piston 20 and its handle 28. The central hole 42 is made oversized to allow the piston 20 to tilt slightly with respect to the tubular member 12 so that the top peripheral edge 46 of the tubular member will always seat flush against the ceiling when the stipple applicator is raised at almost any angle near vertical and bumped against the ceiling.

When the tubular member 12 is loaded with the plaster compound, and the extrusion head 24 is clamped over the open top end 14, then the operator draws the tubular member 12 down, while the vertical handle is steadied on the floor. This tends to raise the piston 20 within the tubular member and thus compact the plaster compound. In so doing, the porous cover or extrusion head 24 is bowed upwardly, as is shown in dotted lines at 24' in FIG. 1 by the compaction of the plaster compound within the tubular member 12.

Since the porous cover or extrusion head 24' is slightly convex as is shown in dotted lines in FIG. 1, a small central area of the extrusion head flattens out on the ceiling. In a split second, the plaster compound within the tubular member is compressed by a double compression action—the upward movement of the piston 20 and the downward flattening action of the extrusion head 24'. The result is the extrusion of the plaster compound through the extrusion head 24', but this action is restricted by the seating action of the top peripheral edge 46 of the tubular member flush against the ceiling. This top edge 46 serves as a dam or trap around the extruded plaster compound to prevent spill-overs that would otherwise tend to run down the outside of the tubular member.

Figure 2:
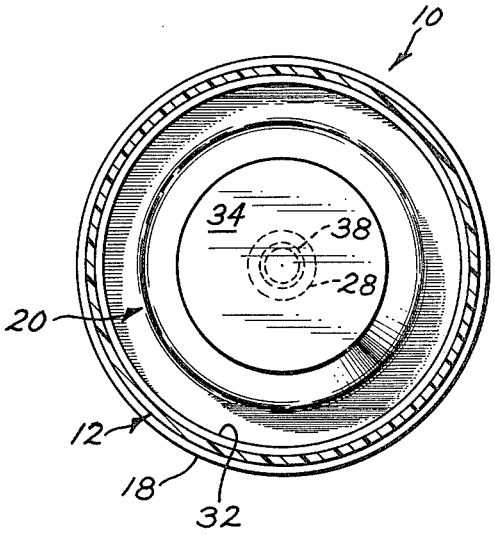
FIG. 2 is a top cross-sectional plan view of the stippled plaster applicator taken on the line 2—2 of FIG. 1, which is shown as circular in transverse cross section and in its empty condition.
Figure 3:
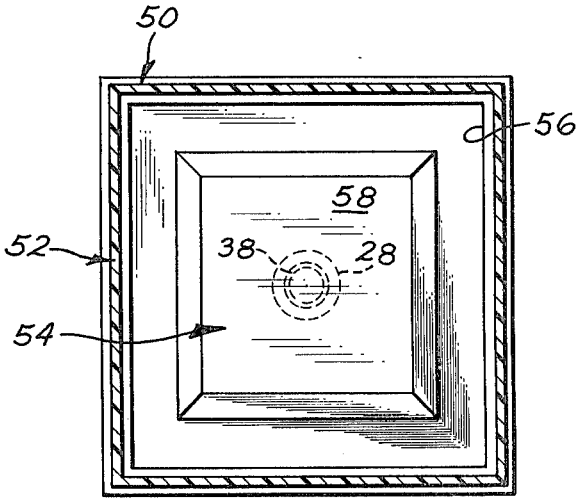
FIG. 3 is a top cross-sectional plan view similar to that of FIG. 2 of a modified version of the applicator that is shown as square or rectangular in transverse cross section.

With particular reference to FIG. 3 of the drawing, a second stipple applicator 50 is illustrated and includes a tubular member 52 housing within a chamber (unnumbered) thereof a mating piston 54 which are both square or rectangular in plan view, rather than circular as in the case of the stipple applicator 10 of FIGS. 1 and 2. The piston 54 has a narrow peripheral rim 56 and a central raised top surface 58 which may be either of a square, rectangular or circular shape, as viewed in plan.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. A stipple applicator for applying a stippled coating of paste material to a surface comprising a generally tubular member defining a chamber adapted to receive therein paste material, said tubular member having an end portion defining an opening, a piston disposed within said chamber, means for moving said piston in a direction toward said opening to urge paste material adapted to be housed within said chamber toward said opening, flexible screen spanning said opening and being responsive to the movement of paste material through said opening for restricting the flow of paste material from said opening and through said flexible screen for deposit upon a surface and being slightly bowed convexly outwardly under the influence of the piston, said flexible screen being further operative under the influence of the paste material compressed thereagainst by a double compression action of said piston moving towards said flexible screen while the latter is deflected toward said opening and toward a less bowed condition when the flexible screen is forcefully urged against a surface upon which a stippled coating is adapted to be applied.

2. The stipple applicator as defined in claim 1 wherein said flexible screen is normally disposed in a plane normal to the direction of movement of said piston when uninfluenced by the paste material.

3. The stipple applicator as defined in claim 1 including means for clamping said flexible screen to an exterior of said tubular member end portion.

4. The stipple applicator as defined in claim 1 including an elongated handle carried by said piston and projecting through an opening in a wall at a second end portion of said tubular member opposite said first-mentioned end portion, and said wall opening being relatively larger than the cross-sectional size of said handle to permit the handle and piston to tilt relative to the axis of said tubular member.

5. The stipple applicator as defined in claim 1 including means for limiting the deflection of said flexible screen from its slightly bowed convex position toward the less bowed condition thereof upon the movement of said tubular member toward a surface upon which a stippled coating is adapted to be applied.

6. The stipple applicator as defined in claim 1 including means for limiting the deflection of said flexible screen from its slightly bowed convex position toward the less bowed condition thereof upon the movement of said tubular member toward a surface upon which a stippled coating is adapted to be applied, and said deflection limiting means being a terminal edge of said tubular member end portion which abuts a surface upon which a stippled coating is adapted to be applied.

7. The stipple applicator as defined in claim 2 including means for limiting the deflection of said flexible screen from its slightly bowed convex position toward the less bowed condition thereof upon the movement of said tubular member toward a surface upon which a stippled coating is adapted to be applied.

8. The stipple applicator as defined in claim 2 including means for limiting the deflection of said flexible screen from its slightly bowed convex position toward the less bowed condition thereof upon the movement of said tubular member toward a surface upon which a stippled coating is adapted to be applied, and said deflection limiting means being a terminal edge of said tubular member end portion which abuts a surface upon which a stippled coating is adapted to be applied.

9. The stipple applicator as defined in claim 2 including means for clamping said flexible screen to an exterior of said tubular member end portion.

10. The stipple applicator as defined in claim 2 including an elongated handle carried by said piston and projecting through an opening in a wall at a second end portion of said tubular member opposite said first-mentioned end portion, and said wall opening being relatively larger than the cross-sectional size of said handle to permit the handle and piston to tilt relative to the axis of said tubular member.

11. The stipple applicator as defined in claim 7 including means for clamping said flexible screen to an exterior of said tubular member end portion.

12. The stipple applicator as defined in claim 7 including an elongated handle carried by said piston and projecting through an opening in a wall at a second end portion of said tubular member opposite said first-mentioned end portion, and said wall opening being relatively larger than the cross-sectional size of said handle to permit the handle and piston to tilt relative to the axis of said tubular member.

13. The stipple applicator as defined in claim 8 including means for clamping said flexible screen to an exterior of said tubular member end portion.

14. The stipple applicator as defined in claim 8 including an elongated handle carried by said piston and projecting through an opening in a wall at a second end portion of said tubular member opposite said first-mentioned end portion, and said wall opening being relatively larger than the cross-sectional size of said handle to permit the handle and piston to tilt relative to the axis of said tubular member.

15. A process for applying a stippled textured finish of paste material upon a surface comprising the steps of housing paste material within a tubular member between an internal movable piston and an opening covered by a flexible screen normally disposed in a plane normal to an axis of the tubular member and the direction of movement of the piston toward the flexible screen, moving the piston toward the flexible screen to urge the paste material thereagainst and bow the flexible screen at least slightly convexly outwardly, and forcefully moving the slightly convexly outwardly bowed flexible screen against a surface to effect a double compression action by the simultaneous movement of the piston towards the flexible screen and a decrease in the bowed nature of the flexible screen to restrictively extrude therethrough the paste material resulting in the application of the latter in a stippled texture finish upon the surface.

16. The process as defined in claim 15 including the step of moving the flexible screen away from the surface and repeatedly, sequentially and continuously moving the piston toward the flexible screen, moving the slightly convexly bowed flexible screen against the surface, and moving the flexible screen away from the surface while additionally moving the tubular member along the surface to stipple adjacent surface areas thereof.

17. The process as defined in claim 15 including the step of abruptly temporarily abutting a terminal edge of the tubular member adjacent the opening against the surface to limit the decrease in the bowed nature of the flexible screen.

18. The process as defined in claim 16 including the step of abruptly temporarily abutting a terminal edge of the tubular member adjacent the opening against the surface to limit the decrease in the bowed nature of the flexible screen.

* * * * *